E4819 OR 4,386,244 SEARCH ROOM

United Sta[illegible]
Murakami et al.

11] 4,386,244
45] May 31, 1983

[54] ELECTROMAGNETIC TRANSDUCER

[75] Inventors: Fumikazu Murakami, Tokyo; Shizuo Funayama, Kamagaya, both of Japan

[73] Assignee: Kabushiki Kaisha Daini Seikosha, Tokyo, Japan

[21] Appl. No.: 357,578

[22] Filed: Mar. 12, 1982

[30] Foreign Application Priority Data

Mar. 20, 1981 [JP] Japan ..... 56-39773[U]

[51] Int. Cl.[3] ..... H04R 9/02
[52] U.S. Cl. ..... 179/179; 179/114 R; 179/117
[58] Field of Search ..... 179/114 R, 115 R, 117, 179/119 R, 179; 336/65, 83; 335/231

[56] References Cited

U.S. PATENT DOCUMENTS 2,220,942 11/1940 Morrison ..... 179/114 R
2,249,158 7/1941 Morrison ..... 179/114 R
2,754,373 7/1956 Shaper ..... 179/114 R
3,515,818 6/1970 Tibbetts ..... 179/114 R
3,542,974 11/1970 Blastic ..... 179/114 R
3,593,217 7/1971 Weber ..... 336/65
4,314,221 2/1982 Satou ..... 336/83

*Primary Examiner*—Gene Z. Rubinson
*Assistant Examiner*—L. C. Schroeder
*Attorney, Agent, or Firm*—Robert E. Burns; Emmanuel J. Lobato; Bruce L. Adams

[57] ABSTRACT

An electromagnetic transducer in which one end of a coil terminal is connected with a step portion of a magnetic core body made of soft magnetic material such as pure iron and the other end of which is connected with a step portion of a supporting frame made of metal on the same plane by spot welding. An insulation between the supporting frame and the magnetic core body is made by interposing an insulator therebetween or by coating the surface of the magnetic core body with a resin film by evaporation.

By treating the coil terminals on the same plane, the expensive substrate for making an electrical connection is not needed and the assembly cost is extremely reduced.

4 Claims, 4 Drawing Figures

ELECTROMAGNETIC TRANSDUCER

BACKGROUND OF THE INVENTION

The present invention relates to an electromagnetic transducer, and more particularly to an improvement in a treatment of terminals of a coil wire.

FIG. 1 shows a conventional electromagnetic transducer. In the drawing, reference numeral 6 denotes a magnetic core body, on which is mounted a coil 5. A magnet 4 is mounted on the magnetic core body 6 to surround the coil 5. Reference numeral 1 denotes a vibration plate, on the center of which is fixed a movable iron piece 2, and the periphery of the vibration plate 1 is supported by a supporting frame 3. The magnetic core body 6 is provided with a notch portion 10 and a substrate 7 is fixed on a lower surface of the magnetic core body.

FIG. 2 shows a lower plan view of the magnetic core body 6, wherein reference numerals 8 and 9 respectively denote electro-conductive patterns deposited on the substrate 7. Two terminals 11, 12 of the coil 5 are led to the lower surface of the magnetic core body 6 through the notch portion 10 and connected with the patterns 8 and 9 by welding.

In the conventional structure, the workability is inferior since it is necessary to lead the coil terminals to the rear side of the substrate to treat them.

Further the treatment of the coil terminals costs much money and time since the expensive substrate is used and it is difficult to connect them.

BRIEF SUMMARY OF THE INVENTION

Accordingly, the present invention aims to eliminate the above noted drawbacks, and therefore it is an object of the present invention to provide an inexpensive transducer in which a substrate is not needed by connecting coil terminals respectively with a supporting frame made of metal and a magnetic core body.

These and other objects, features and advantages of the invention will become more apparant upon a reading of the following detailed specification and drawing.

DETAILED DESCRIPTION OF THE PREFERRED EMBODIMENT

Figure 1:
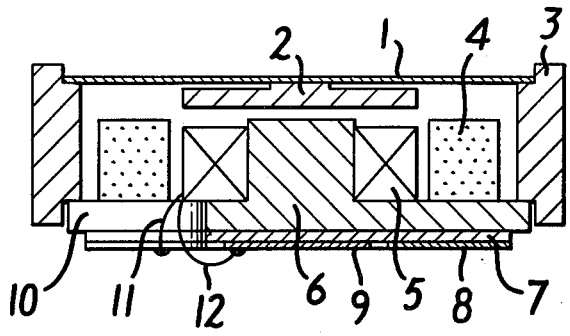
FIG. 1 shows a sectional view of a conventional electromagnetic transducer and FIG. 2 shows a plan view of the same.
Figure 2:
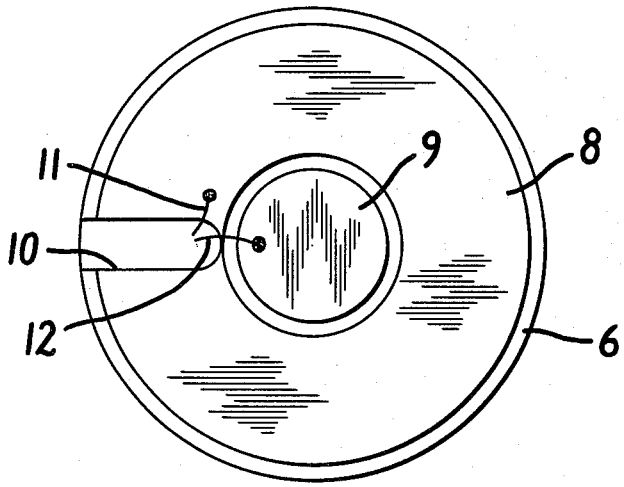
Figure 3:
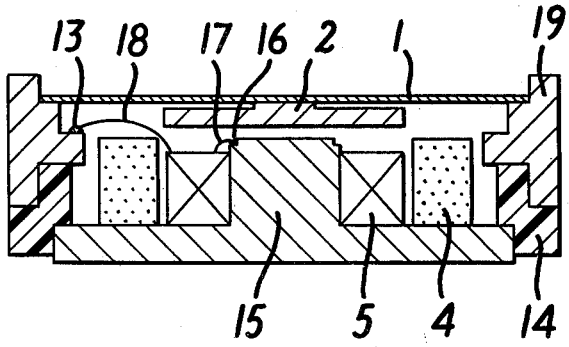
FIG. 3 and FIG. 4 are sectional views of an electromagnetic transducer according to the present invention.

FIG. 3 shows an embodiment of the present invention. A supporting frame 19 made of non-magnetic metal such as brass is provided with a step portion 13. One end 18 of a coil terminal is connected with the step portion by spot welding. A magnetic core body 15 made of soft magnetic material such as pure iron is provided with a step portion 16. The other end 17 of the coil terminal is connected with the step portion 16 by spot welding. An insulator 14 formed by insulating material such as plastics is interposed between the supporting frame 12 and the magnetic core body 15.

By this structure, the coil 5 can be connected with the step portion 16 of the magnetic core body 15 and the step portion 13 of the supporting frame 12 on the same plane by welding without leading the coil terminals fixed on the upper surface of the magnetic core body to the lower surface of the same. As a result the workability is extremely improved.

Figure 4:
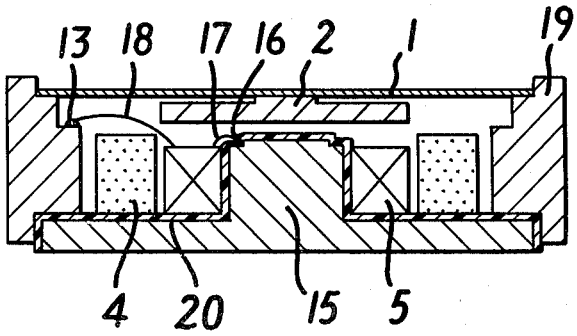

FIG. 4 shows another embodiment of the present invention. An upper surface (the surface on which the coil 5 and magnet 4 are mounted) of the magnetic core body 15 is coated with a resin film 20 by evaporation or the like. The resin film serves to insulate between the supporting frame 12 made of metal and the magnetic core body 15 made of pure iron or the like, and between the coil 5 and the magnetic core body 15. The coil terminals 17 and 18 are also connected respectively with the step portion 16 of the magnetic core body and the step portion 13 of the supporting frame.

As illustrated so far, the expensive substrate for making an electrical connection is not needed and the assembly cost is extremely reduced by treating the coil terminals on the same plane.

What we claim is:

1. An electromagnetic transducer comprising at least: a magnetic core body (15); a coil (5) mounted on the magnetic core body; a magnet (4); a vibration plate (1) spaced from the magnetic core body, coil (5) and magnet (4); a movable iron piece (2) fixed on the vibration plate; and a supporting frame (19) to support the periphery of the vibration plate (1), wherein one end of a coil terminal (17, 18) is connected with the magnetic core body and the other end of which is connected with the supporting frame made of metal to make an electrical connection.

2. An electromagnetic transducer as claimed in claim 1, wherein an insulator (14) is interposed between the magnetic core body (15) and the supporting frame (19).

3. An electromagnetic transducer as claimed in claim 1, wherein a step portion (13) is provided at the inner surface of the supporting frame (19) to connect the coil terminal (17, 18) therewith.

4. An electromagnetic transducer as claimed in claim 1, wherein the surface of the magnetic core body (15) is coated with resin (20).

* * * * *